US005579558A

United States Patent [19]

Newman, Jr. et al.

[11] Patent Number: 5,579,558

[45] Date of Patent: Dec. 3, 1996

[54] TOOL HANDLE WITH LOCKING ASSEMBLY

[75] Inventors: Robert D. Newman, Jr.; Robert D. Newman, Sr., both of P.O. Box 377, Greenwood, Mo. 64034; Buford Guittar, Greenwood, Mo.

[73] Assignees: Robert D. Newman, Sr.; Robert D. Newman, Jr., both of Greenwood, Mo.

[21] Appl. No.: 496,577

[22] Filed: Jun. 29, 1995

[51] Int. Cl.[6] ..... B25G 1/04

[52] U.S. Cl. ..... 16/115; 15/144.4; 81/177.1; 403/109

[58] Field of Search ..... 16/115, 110.5, 16/DIG. 41, DIG. 24, DIG. 25; 15/144.4; 403/109, 378; 81/177.1, 489

[56] References Cited

U.S. PATENT DOCUMENTS

| | | | |
|---|---|---|---|
| 3,024,031 | 3/1962 | Davidson | 16/115 |
| 3,375,044 | 3/1968 | Peterson | 15/115 |
| 4,196,491 | 4/1980 | Baril | 15/144.4 |
| 4,238,164 | 12/1980 | Mazzolla | 403/109 |
| 4,325,157 | 4/1982 | Balint et al. | 16/115 |
| 4,466,152 | 8/1984 | Moss et al. | 15/144.4 |
| 4,793,646 | 12/1988 | Michaud, Jr. | 16/115 |
| 5,220,707 | 6/1993 | Newman, Sr. et al. | 16/115 |
| 5,226,198 | 7/1993 | Martin | 81/489 |

*Primary Examiner*—Chuck Y. Mah

*Attorney, Agent, or Firm*—Hovey, Williams, Timmons & Collins

[57] ABSTRACT

An extension handle is provided for extending the reach of a tool such as a paint roller or the like. The handle includes a first end presenting an axial opening, and is provided with a locking mechanism for locking the tool on the extension handle. The locking mechanism includes a housing supported on the extension handle at the first end, a pin supported by the housing for shifting movement in a direction transverse to the length of the extension handle between a locked position extending into the opening and an unlocked position withdrawn from the opening, a biasing member for biasing the pin toward the locked position, and a release button for releasing the biasing member and shifting the pin to the unlocked position. The extension handle is adapted for use with a special tool having a handle presenting a free end that is sized for receipt in the axial opening of the extension handle and that includes a cavity within which the pin is received when the handle is positioned in the axial opening and the pin is in the locked position. However, through the use of adaptors, the extension handle can also be used with conventional tools having handles presenting internally threaded open ends or quick-release mechanisms.

22 Claims, 1 Drawing Sheet

TOOL HANDLE WITH LOCKING ASSEMBLY

BACKGROUND OF THE INVENTION

1. Field of the Invention

The present invention relates generally to hand tools and, more particularly, to an extension handle apparatus for extending the reach of hand tools such as paint rollers, squeegees, brushes and the like.

2. Discussion of the Prior Art

It is known to provide extension handles for extending the reach of hand tools such as paint rollers, squeegees, brushes and the like so that the tools can be employed in hard to reach areas such as at heights above the normal reach of a worker. In order to enable the use of a hand tool with such an extension handle, it is conventional to construct the tool with a hollow, internally threaded handle, and to design the extension handle with an externally threaded male end adapted for threaded receipt in the tool handle. In this manner, the extension handle can be attached to the tool by threading it into the tool handle. However, there is a tendency for the tool to twist on the handle during use such that the tool becomes unscrewed and falls off of the extension handle.

Another known extension handle construction is designed specifically for use with a special tool having a handle adapted for connection with the extension handle. The tool handle presents an open end sized for receipt of the extension handle and a quick-release mechanism is provided for securing the tool on the extension handle and for selectively releasing the extension handle. However, because the extension handle is designed specifically for use with a particular tool design, it cannot be used with conventional tools having an internally threaded handle.

OBJECTS AND SUMMARY OF THE INVENTION

It is an object of the present invention to provide a tool reach extension apparatus in which attachment and removal of the tool is simplified by the provision of a release button for releasing the tool from locking engagement with the extension handle.

It is another object of the invention to provide an apparatus including an extension handle adapted not only for use with a special tool, but also for use with any of a plurality of different tool constructions having various configurations, and to provide adaptors capable of adapting the extension handle for use with such tools.

In accordance with these and other objects evident from the following description of a preferred embodiment of the invention, an apparatus is provided for use in extending the reach of a tool. The apparatus includes an elongated extension handle including a first end presenting an axial opening, and a locking means for locking the tool on the first end of the extension handle. The locking means includes a housing supported on the extension handle at the first end, a pin supported by the housing for shifting movement in a direction transverse to the length of the extension handle between a locked position extending into the opening and an unlocked position withdrawn from the opening, a biasing means for biasing the pin toward the locked position, and a release means for releasing the biasing means and shifting the pin to the unlocked position. The pin in the locked position prevents the tool from being pulled from the extension handle.

By providing a construction in accordance with the present invention, numerous advantages are realized. For example, by providing an extension handle with a locking means having a pin biased toward the locking position, it is possible to insert and lock a tool in place on the extension handle without pushing a pin, button or lever. In addition, by providing a release means for unlocking the pin, the tool or adaptor can be easily and quickly released with the push of a button, and it is not necessary to unscrew the tool as required with conventional extension handles. The pin also holds the tool or adaptor against both longitudinal and rotational movement relative to the extension handle, removing slack or plat in the connection.

Through the use of an appropriate adaptor, the apparatus is capable of use with a conventional tool having an internally threaded handle. The adaptor includes a first end that is externally threaded for receipt in the open end of the tool handle, and a second end that is sized for receipt in the axial opening of the extension handle arid is of a cross-sectional shape corresponding to the shape of the axial opening. The second end includes a cavity within which the pin is received when the adaptor is positioned in the axial opening and the pin is in the locked position.

The apparatus may also be used with other available quick-release extension tools through the use of an adaptor having a first end that is sized for receipt in the open end of the tool handle and adapted for engagement by the quick release mechanism. The adaptor also includes a second end that is sized for receipt in the axial opening of the first extension handle and is of a cross-sectional shape corresponding to the shape of the axial opening. The second end includes a cavity within which the pin is received when the adaptor is positioned in the axial opening and the pin is in the locked position.

BRIEF DESCRIPTION OF THE DRAWING FIGURES

The preferred embodiment of the invention is described in detail below with reference to the attached drawing figures, wherein.

DETAILED DESCRIPTION OF A PREFERRED EMBODIMENT

Figures 1, 2, 3, 4, 5, 6, 7, 8, 9:
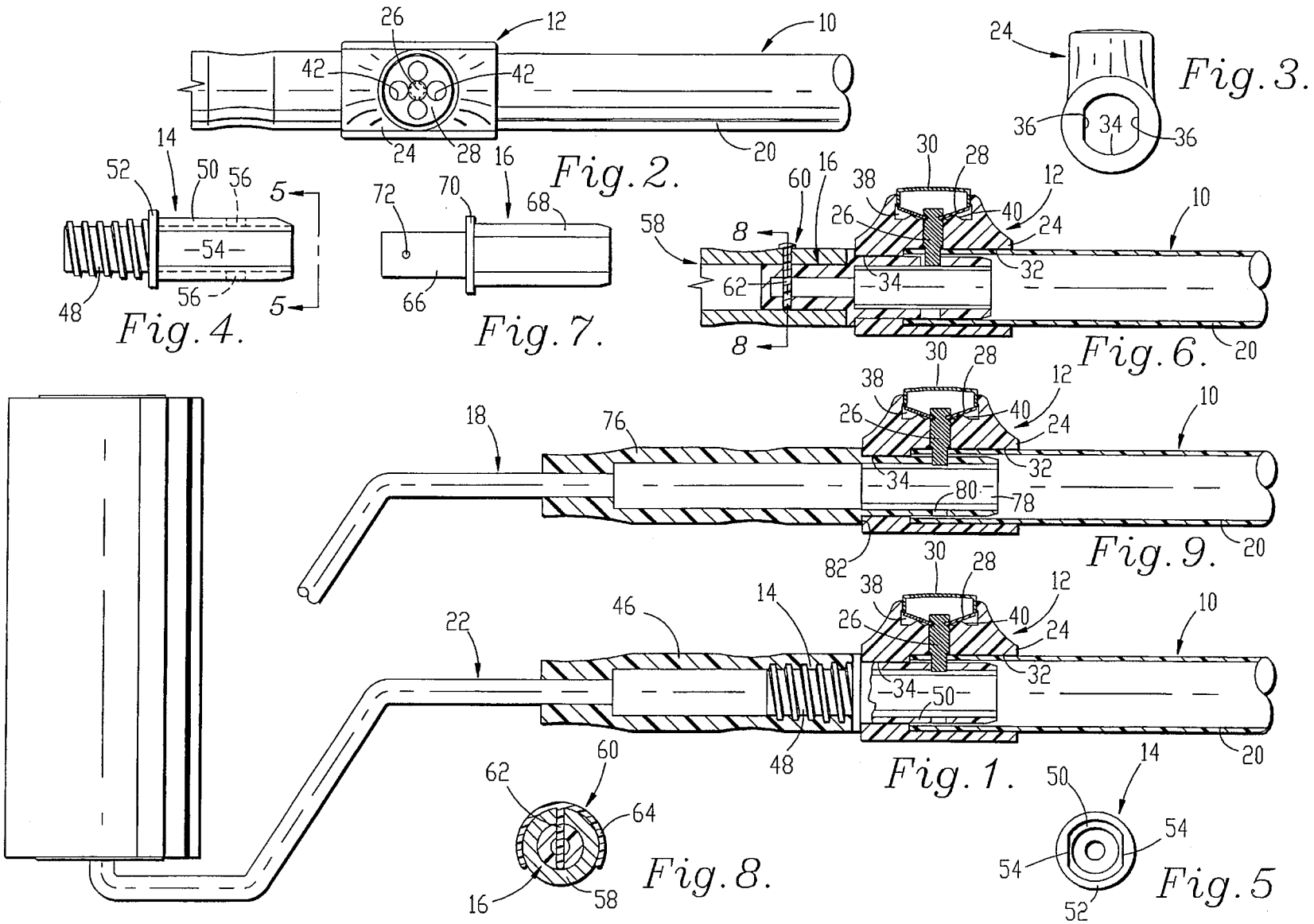
FIG. 1 is a side sectional view of an extension apparatus and adaptor constructed in accordance with the preferred embodiment of the present invention, illustrating the apparatus secured-to a conventional tool having an internally threaded handle.
FIG. 2 is a fragmentary top plan view of the apparatus, illustrating a locking assembly of the apparatus with a release button of the assembly removed.
FIG. 3 is an end elevational view of a housing of the locking assembly.
FIG. 4 is a side elevational view of the adaptor.
FIG. 5 is an end elevational view of the adaptor.
FIG. 6 is a side sectional view of the apparatus, illustrating a second type of adaptor for use with a conventional tool having an open ended handle having a quick release mechanism.
FIG. 7 is a side elevational view of the second type of adaptor.
FIG. 8 is a sectional view through line 8—8 of FIG. 6.
FIG. 9 is a side sectional view of the apparatus, illustrating a tool constructed in accordance with the present invention for use with the extension apparatus.

An extension apparatus constructed in accordance with the preferred embodiment is illustrated in FIG. 1, and broadly includes an elongated extension handle 10, and a locking means 12 for locking a tool on the end of the extension handle. The apparatus is shown in FIGS. 1–5 in use with an adaptor for permitting the extension apparatus to be used with a conventional tool having an internally threaded handle. A second type of adaptor 16 is illustrated in FIGS. 6–8, and permits the extension apparatus to be used with a conventional tool having a handle provided with a quick release mechanism. As shown in FIG. 9, a tool 18 can also be constructed with a custom handle that fits directly on the extension apparatus so that no adaptor is required.

Returning to FIG. 1, the extension handle 10 includes an elongated tubular member 20 formed of metal or any other suitable material capable of supporting the tool 22 at one end thereof while permitting a user to grip the opposite end of the member and manipulate the tool. The end of the extension handle is open, and a transverse hole extends through the side wall of the member 44 at a location spaced slightly from the end of the member.

Preferably, the extension handle includes a pair of handle members, one of which is telescopically received in the other so that the length of the extension handle can be adjusted. An example of such an extension handle is illustrated in U.S. Pat. No. 5,220,707 to Newman, Sr., et al., incorporated herein by this express reference.

The locking means 12 includes a housing 24, a pin 26, a biasing member 28 and a release button 30. The housing 24 is supported on the extension handle at the open end thereof, and is secured to the handle member against relative shifting movement. Although it is preferred that the housing be assembled on the extension handle at the time of manufacture of the handle, it is also possible to retrofit the locking means on an existing extension handle or to form the extension handle with an integral housing.

The housing 24 presents a T-shaped configuration including a tubular portion sized for receipt on the end of the handle member, and an upstanding rim protruding from the tubular portion. The inner diameter of the tubular portion is stepped, presenting a large diameter section 32 having a diameter about equal to or slightly less than the outer diameter of the handle member, and a small diameter section 34 presenting a stop or shoulder against which the end of the handle member abuts when the housing is assembled on the member. The small diameter:section is non-circular in cross-sectional shape, as shown in FIG. 3, and preferably includes a pair of flat side faces that align the locking means with the tool or adaptor to be connected to the extension handle.

The upstanding rim of the housing 24 includes a central depression 38 and a hole collinear with the transverse hole of the handle member within which the pin is received. The depression 38 includes a generally circular bottom wall on which an annular ridge 40 is formed. The ridge is spaced radially from the hole and defines a fulcrum against which the biasing member 28 is forced during operation of the locking means, as described below. The depression also includes a cylindrical side wall that is sized for receipt of the biasing member and the release button 30. Preferably, the side wall of the depression 38 is undercut and the button 30 is formed with a pair of diametrically opposed, radially protruding lips so that the button is retained in the depression once assembled on the housing.

The pin 26 is supported by the housing for shifting movement in a direction transverse to the length of the extension handle between a locked position extending into the interior of the handle member, as shown in FIG. 1, and an unlocked position withdrawn from the opening. The pin is formed of metal, plastic, or any other suitable material, and can be round, square, rectangular or other shape. The pin includes a lower stepped portion having a diameter substantially equal to the diameter of the transverse hole in the handle member. The remaining portion of the pin is of a larger diameter and prevents the pin from extending into the extension handle beyond the lower stepped portion. In addition, a circumferential groove is formed adjacent the end of the pin opposite the lower stepped portion. The groove is adapted to receive the biasing member 28 and to retain the biasing member on the pin as the pin is moved between the locked and unlocked positions.

The biasing member 28 is a cupped-shaped washer formed of plastic, metal or the like, and includes a central aperture sized for receipt in the circumferential groove of the pin 26, and a plurality of bias relief holes 42, shown in FIG. 2, extending radially from the central aperture. The biasing member presents an upper concave face and a lower convex face. The bias relief holes 42 weaken the bias of the member to a level sufficient to permit shifting of the member between the locked position illustrated in FIG. 1 and an unlocked position in which the biasing member is pivoted about the fulcrum ridge to pull the pin from the extension handle.

The release button 30 includes a lower edge having a diameter about equal to the diameter of the outer edge of the biasing member. As the button is depressed, it exerts a force on the outer circumferential edge of the biasing member that is counteracted by an upward force exerted by the fulcrum ridge 40. When the downward force reaches a magnitude sufficient to pivot the biasing member about the ridge, the biasing member snaps into the unlocked position. This movement of the biasing member lifts the pin into the depression, withdrawing the pin into the transverse hole of the extension handle member. Thereafter, when the button 30 is released, the force exerted on the biasing member by the fulcrum ridge 40 causes the member to return to the locked position shown in FIG. 1.

In order to permit use of the extension handle with a conventional tool 22 having an internally threaded handle 46, illustrated as a paint roller in FIG. 1, the adaptor 14 is provided. The adaptor is shown in FIG. 4, and includes a first end 48 designed to attach to the handle 46 of the tool and a second end 50 designed to attach to the extension handle 10. A circumferential flange 52 separates the ends from one another and defines a stop against which both the tool handle and extension handle bear upon assembly of the apparatus.

Preferably, the first end 48 of the adaptor 14 is externally threaded so that it can be threaded into and out of the handle 46 prior to securing the tool to the extension handle. The major diameter of the adaptor threads corresponds to the major diameter of the female threads in the handle 46. However, the major diameter of the adaptor threads adjacent the flange 52 is larger than along the remainder of the adaptor so that as the adaptor is screwed into the tool handle 46, the threads on the adaptor grip the handle, locking the two parts together.

The second end 50 of the adaptor 14 is tubular, including a non-circular cross-sectional shape corresponding to the cross-sectional shape of the small diameter section 34 of the housing 24 so that the adaptor 14 must be properly aligned with the extension handle before the adaptor can be pushed into the housing. Preferably, the second end 50 includes opposing flat side faces 54, illustrated in FIG. 5, corresponding to the side faces 36 of the small diameter housing section 34, shown in FIG. 3. Returning to FIG. 4, transverse holes 56 extend through the adaptor wall on opposite sides of the adaptor. The holes 56 are spaced circumferentially from the side faces 54 by an angle of 90° relative to the longitudinal axis of the adaptor. Alternately, the holes may be slots, grooves or any other type of depression sized for receipt of the pin 26.

The tip of the second end 50 of the adaptor 14 is tapered to guide movement of the adaptor into the end of the extension handle member 20 and past the pin 26 so that the pin rides over the adaptor and snaps into one of the holes when the adaptor is seated against the housing. Thereafter, the adaptor 14 is locked to the extension handle and cannot either twist or be moved longitudinally relative to the extension handle. In order to unlock the adaptor 14, it is necessary only to depress the button 30 until the biasing member 28 lifts the pin 26 from the hole in the adaptor. Thereafter, the adaptor may be pulled from the extension handle to release the tool.

In order to permit use of the extension handle with a tool 58, provided with a quick release mechanism, the adaptor 16 is provided, as illustrated in FIG. 6. The handle of the tool 58 is hollow and includes a transverse hole within which a snap button 60 is received. Normally, a conventional extension handle is provided which includes a male end sized for receipt in the handle and formed with a transverse hole positioned for alignment with the hole in the handle so that the snap button extends through both holes to hold the tool on the extension handle. As shown in FIG. 8, the snap button 60 includes a pin 62 supported on a crescent-shaped spring clip 64, wherein the spring clip is formed of a diameter smaller than the diameter of the tool handle. Thus, the spring clip grips the handle of the tool 58 when the pin is inserted through the holes.

The adaptor 16 is illustrated in FIG. 7, and includes a first end 66 designed to attach to the handle of the tool and a second end 68 designed to attach to the extension handle. A circumferential flange 70 separates the ends from one another and defines a stop against which both the tool handle and extension handle bear upon assembly of the apparatus.

Preferably, the first end 66 of the adaptor 16 is tubular or cylindrical and includes a transverse hole 72 sized to receive the pin 62 of the snap button 60. The second end 68 of the adaptor is identical in construction to the second end 50 of the adaptor 14. In order to secure the adaptor 16 to the tool handle of the tool 58, the first end 66 of the adaptor is inserted into the handle so that the hole 72 in the adaptor is aligned with a corresponding hole in the handle. Thereafter, the snap button 60 is secured to the handle with the pin extending into the holes, locking the adaptor to the tool. The tool is secured to the extension handle 10 by inserting the second end 68 of the adaptor 16 into the housing until the flange 70 seats against the housing with one of the transverse holes in the adaptor aligned with the pin 26. With the pin seated in one of the holes, the tool 58 is locked against twisting or longitudinal movement relative to the extension handle 10.

The tool 18, shown in FIG. 9, is constructed in accordance with the preferred embodiment and includes a construction which obviates the need for a separate adaptor. The tool 18 includes a hollow tubular handle 76 including a free end that is sized for receipt in the axial opening of the extension handle 10 and is of a cross-sectional shape corresponding to the cross-sectional shape of the small diameter section 34 of the housing 24. The handle is preferably integral with the tool, but could alternately be attached to the tool by rivets, screws, an adhesive, or a threaded connection or the like. Preferably, the free end of the handle 76 includes opposing flat side faces 78 corresponding to the side faces 36 of the small diameter housing section 34, and a transverse hole 80 extends through the tool handle. The hole is spaced circumferentially from the side faces 78 by an angle of 90° relative to the longitudinal axis of the handle. The tool 18 is secured to the extension handle 10 by inserting the free end of the handle into the housing until the handle seats against the housing with the hole 80 in the free end aligned with the pin 26. With the pin seated in the hole 80, the tool is locked against twisting or longitudinal movement relative to the extension handle. Preferably, the free end of the handle is stepped to define a stop surface 82 that seats against the housing when the handle is locked on the extension handle.

Although the present invention has been described with reference to the preferred embodiment illustrated in the attached drawing figures, it is noted that substitutions may be made and equivalents employed herein without departing from the scope of the invention as recited in the claims.

What is claimed is:

1. An apparatus for use in extending the reach of a tool, the apparatus comprising:

an elongated extension handle including a first end presenting an axial opening; and a locking means for locking the tool on the first end of the extension handle, the locking means including a housing supported on the extension handle at the first end, a pin supported by the housing for shifting movement in a direction transverse to the length of the extension handle between a locked position extending into the opening and an unlocked position withdrawn from the opening, a biasing means for biasing the pin toward the locked position, and a release means for releasing the biasing means and shifting the pin to the unlocked position, the pin in the locked position preventing the tool from being pulled from the extension handle.

2. An apparatus as recited in claim 1, wherein the housing is generally tubular and includes an inner surface that is stepped, the inner surface presenting a large diameter section sized for receipt on the extension handle and a small diameter section extending axially from the first end of the extension handle.

3. An apparatus as recited in claim 2, wherein the housing and the first end of the extension handle include collinear transverse holes within which the pin is supported for movement.

4. An apparatus as recited in claim 3, wherein the transverse hole in the extension handle is smaller than the transverse hole in the housing, and the pin includes a first axial section having a diameter corresponding to the hole in the extension handle and a second axial section having a diameter corresponding to the hole in the housing so that the pin is restricted from extending into the extension handle beyond the first axial section.

5. An apparatus as recited in claim 2, wherein the small diameter section includes a non-circular cross-sectional shape adapted to align the tool with the extension handle during attachment.

6. An apparatus as recited in claim 5, wherein the small diameter section presents a pair of flat side faces, each opposed to the other and spaced circumferentially from the transverse hole in the housing by 90°.

7. An apparatus as recited in claim 1, wherein the biasing means includes a biasing member presenting a cupped washer configuration.

8. An apparatus as recited in claim 1, wherein the release means includes a button supported on the housing for movement between the locking position and the unlocking position, the biasing means biasing the button toward the locked position.

9. An apparatus for use in extending the reach of a tool, wherein the tool includes a handle presenting an open end that is internally threaded, the apparatus comprising:

an elongated extension handle including a first end presenting an axial opening;

an adaptor including a first end that is externally threaded for receipt in the open end of the tool handle and a second end that is sized for receipt in the axial opening of the extension handle; and a locking means for locking the second end of the adaptor in the axial opening of the extension handle so that when the adaptor is secured to the tool and locked in the axial opening of the extension handle, the tool is retained on the extension handle, the locking means including a housing supported on the extension handle at the first end, a pin supported by the housing for shifting movement in a direction transverse to the length of the extension handle between a locked position extending into the opening and an unlocked position withdrawn from the opening, a biasing means for biasing the pin toward the locked position, and a release means for releasing the biasing means and shifting the pin to the unlocked position, the pin engaging the second end of the adaptor when the adaptor is inserted into the axial opening and the pin is in the locked position, preventing the adaptor from being pulled from the extension handle.

10. An apparatus as recited in claim 9, wherein the housing is generally tubular and includes an inner surface that is stepped, the inner surface presenting a large diameter section sized for receipt on the extension handle and a small diameter section extending axially from the first end of the extension handle.

11. An apparatus as recited in claim 10, wherein the small diameter section includes a non-circular cross-sectional shape adapted to align the adaptor with the extension handle during attachment.

12. An apparatus as recited in claim 11, wherein the second end of the adaptor includes a non-circular cross-sectional shape corresponding to the shape of the small diameter section of the housing.

13. An apparatus as recited in claim 11, wherein the small diameter section presents a pair of flat side faces, each opposed to the other and spaced circumferentially from the transverse hole in the housing by 90°.

14. An apparatus as recited in claim 13, wherein the second end of the adaptor includes a transverse depression positioned for alignment with the pin when the adaptor is positioned in the first end of the extension handle, and a pair of flat side faces each opposed to the other and spaced circumferentially from the transverse depression in the adaptor by 90°.

15. An apparatus for use in extending the reach of a tool, wherein the tool includes a handle presenting an open end sized for receipt of a first extension handle and a quick release mechanism for releasing the first extension handle from the tool, the apparatus comprising:

an elongated second extension handle including a first end presenting an axial opening;

an adaptor including a first end that is sized for receipt in the open end of the tool handle and is adapted for engagement by the quick release mechanism, and a second end that is sized for receipt in the axial opening of the second extension handle; and a locking means for locking the second end of the adaptor in the axial opening of the second extension handle so that when the adaptor is received in the tool and locked in the axial opening of the second extension handle, the tool is retained on the second extension handle, the locking means including a housing supported on the second extension handle at the first end, a pin supported by the housing for shifting movement in a direction transverse to the length of the second extension handle between a locked position extending into the opening and an unlocked position withdrawn from the opening, a biasing means for biasing the pin toward the locked position, and a release means for releasing the biasing means and shifting the pin to the unlocked position, the pin engaging the second end of the adaptor in the locked position to prevent the adaptor from being pulled from the second extension handle.

16. An apparatus as recited in claim 15, wherein the housing is generally tubular and includes an inner surface that is stepped, the inner surface presenting a large diameter section sized for receipt on the extension handle and a small diameter section extending axially from the first end of the extension handle.

17. An apparatus as recited in claim 16, wherein the small diameter section includes a non-circular cross-sectional shape adapted to align the adaptor with the extension handle during attachment.

18. An apparatus as recited in claim 17, wherein the second end of the adaptor includes a non-circular cross-sectional shape corresponding to the shape of the small diameter section of the housing.

19. An apparatus as recited in claim 17, wherein the small diameter section presents a pair of flat side faces, each opposed to the other and spaced circumferentially from the transverse hole in the housing by 90°.

20. An apparatus as recited in claim 19, wherein the second end of the adaptor includes a transverse depression positioned for alignment with the pin when the adaptor is positioned in the first end of the extension handle, and a pair of flat side faces each opposed to the other and spaced circumferentially from the transverse depression in the adaptor by 90°.

21. An adaptor for use in adapting a tool for use with an extension handle, wherein the tool includes a handle presenting an open end that is internally threaded and the extension handle includes a first end presenting an axially extending opening having a non-circular cross-sectional shape, a pin supported for shifting movement in a direction transverse to the length of the extension handle between a locked position extending into the opening and an unlocked position withdrawn from the opening, a biasing means for biasing the pin toward the locked position, and a release means for releasing the biasing means and shifting the pin to the unlocked position, the adaptor comprising:

a first end that is externally threaded for receipt in the open end of the tool handle; and a second end that is sized for receipt in the axial opening of the extension handle and is of a cross-sectional shape corresponding to the shape of the axial opening, the second end including a cavity within which the pin is received when the adaptor is positioned in the axial opening and the pin is in the locked position, the pin in the locked position preventing the adaptor from being pulled from the extension handle, wherein the cavity is a transverse hole positioned for alignment with the pin when the adaptor is positioned in the first end of the extension handle, and the second end includes a pair of flat side faces each opposed to the other and spaced circumferentially from the transverse hole by 90°.

22. An adaptor for use in adapting a tool for use with a first extension handle, wherein the tool includes a handle presenting an open end sized for receipt of a second extension handle and a quick release mechanism for releasing the second extension handle from the tool, and the first extension handle includes a first end presenting an axially extending opening having a non-circular cross-sectional shape, a pin supported for shifting movement in a direction transverse to the length of the first extension handle between a locked position extending into the opening and an unlocked position withdrawn from the opening, a biasing means for biasing the pin toward the locked position, and a release means for releasing the biasing means and shifting the pin to the unlocked position, the adaptor comprising:

a first end that is sized for receipt in the open end of the tool handle and is adapted for engagement by the quick release mechanism; and a second end that is sized for receipt in the axial opening of the first extension handle and is of a cross-sectional shape corresponding to the shape of the axial opening, the second end including a cavity within which the pin is received when the adaptor is positioned in the axial opening and the pin is in the locked position, the pin in the locked position preventing the adaptor from being pulled from the first extension handle, wherein the cavity is a transverse hole positioned for alignment with the pin when the adaptor is positioned in the first end of the extension handle, and the second end includes a pair of flat side faces each opposed to the other and spaced circumferentially from the transverse hole by 90°.

* * * * *